US005395107A

United States Patent [19]

De Pippo

[11] Patent Number: 5,395,107

[45] Date of Patent: Mar. 7, 1995

[54] HITTING TRAINING ATTACHMENT APPARATUS

[76] Inventor: Richard J. De Pippo, 40 Alderbrook Ct., Wrentham, Mass. 02093

[21] Appl. No.: 133,996

[22] Filed: Oct. 12, 1993

[51] Int. Cl.[6] ..... A63B 69/40

[52] U.S. Cl. ..... 273/26 B; 273/35 R

[58] Field of Search ..... 273/26 B, 26 R, 35 R, 273/186.1, 186.2, 186 B

[56] References Cited

U.S. PATENT DOCUMENTS

| | | | |
|---|---|---|---|
| 3,463,492 | 8/1969 | White | 273/26 B |
| 3,463,492 | 8/1969 | White . | |
| 3,516,669 | 6/1970 | Gray | 273/26 B |
| 3,809,397 | 5/1974 | Gruenewald | 273/26 B |
| 4,116,251 | 11/1983 | Solloway | 273/26 B |
| 4,330,121 | 5/1982 | McCafferty . | |
| 5,002,275 | 3/1991 | Beutler | 273/35 R |
| 5,100,148 | 3/1992 | Smith | 273/186 B |
| 5,150,897 | 9/1992 | Wortman | 273/26 B |
| 5,150,897 | 9/1992 | Wortman . | |
| 5,165,683 | 11/1992 | Beutlter | 273/26 B |
| 5,186,699 | 2/1993 | Dimming | 273/26B |

OTHER PUBLICATIONS

USA Today, p. 10C, Dec. 17, 1992.

*Primary Examiner*—Theatrice Brown

*Attorney, Agent, or Firm*—John A. Haug

[57] ABSTRACT

A training aid for developing strength and coordination for a person's swing in swinging a sporting implement, such as a baseball bat, used to strike an object is shown to include a plurality of vanes (16,16',160,260) attached to first and second collars (12,14;120,140;220,232), the vanes formed with an integral spring (46,46') adapted to engage the surface of the bat or other inplement to secure it to the implement. The vanes provide an aerodynamic drag by increasing the force required to swing the implement due to increased air resistance. In one embodiment the vanes are attached and locked to the collars using a radial motion, while in another embodiment the vanes are attached and locked to the collars using a longitudinal motion. In still another embodiment a vane (260) is permanently attached to a segment (220,232) of two collars with several segments being attachable to one another to form a complete unit.

10 Claims, 7 Drawing Sheets

HITTING TRAINING ATTACHMENT APPARATUS

This invention relates generally to sporting goods and more particularly to training apparatus for attachment to sporting goods implements such as a baseball bat to facilitate the development of a stronger and faster swing by a user of the implement.

BACKGROUND OF THE INVENTION

Many sports involve the striking of an object such as a ball or a puck by an implement such as a racket, golf club, baseball bat or hockey stick by swinging the implement into engagement with the object. Through practice and appropriate exercise a person swinging the implement can improve his or her ability in hitting the object more consistently and with greater power. Training aids of various types have been devised to help the development of muscular strength and coordination to produce a quick and powerful swing. For example, with respect to baseball bats it is well known to use a weighted ring having an inside diameter sufficient to fit over a handle of a bat but insufficient for the striking portion of the bat to pass through. Swinging a bat with such a ring can be useful in developing one's muscles however the inertia the extra weight provides is more beneficial for the start of the swing than for that portion of the swing involving the breaking of the wrists in snapping the bat through the ball. Additionally, the weighted ring can be hazadous when used by children such as little leaguers who can easily hurt their fingers by having the ring move toward the handle if the bat is not handled properly to utilize centrifugal force in maintaining the ring out in the environs of the hitting portion of the bat.

Devices are known which employ a plurality of vanes mounted on a body which is lodged on a bat. The vanes extend in a direction parallel to the longitudinal axis of the bat thereby serving to generate aerodynamic drag and promote muscular development and coordination by air resistance to the swinging of the bat. An example of such a device is shown in U.S. Pat. No. 3,809,397. While this device is effective it has the disadvantage that it is, in effect, dedicated to bats having essentially the same size and taper. There is a need to provide a training aid which is more universally usable with bats having a wide variety of sizes and tapers as well as other hitting implements.

SUMMARY OF THE INVENTION

It is therefore an object of the invention to provide a training aid usable with sporting implements such as baseball bats which is inexpensive yet rugged and long lasting and which can be used with a wide variety of bat types, sizes and tapers. Another object is the provision of a training aid which can be used with various types of implements used to strike objects, including implements having a non-tapered section on which it is desired to mount a training aid.

These and other objects, features and advantages of the present invention will become apparent from the following detailed description of the invention.

Briefly, in accordance with the invention, a training aid is provided in the form of an attachment which can be slipped onto an implement used for striking a ball, such as a baseball bat, which is inherently adjustable to fit a wide variety of bat types, sizes and tapers. The attachment has a plurality of vanes each having an inner spring portion formed integraly with the vane. The vanes are mounted between first and second collars, one having a larger aperture than the other in certain embodiments of the invention. The attachment is slipped onto the handle of a bat through the collar having the larger aperture and moved along the longitudinal axis of the bat until movement is limited by the inner surface of the smaller aperture with the spring portion biased against the bat surface at a location spaced longitudinally from the collar. In one embodiment three vanes are radially received and interlocked in grooves formed in the collar. In another embodiment the vanes are longitudinally received and interlocked in grooves formed in the collar. In yet another embodiment a vane is fixed at each opposite end to a segment of a collar and the segments are interconnected to form a complete unit. In yet another embodiment particularly useful with implements having little or no taper the spring is formed with a pair of spaced implement engaging sections and may be used with a pair of collars having the same or different internal diameters.

DETAILED DESCRIPTION OF PREFERRED EMBODIMENTS

Figure 1:
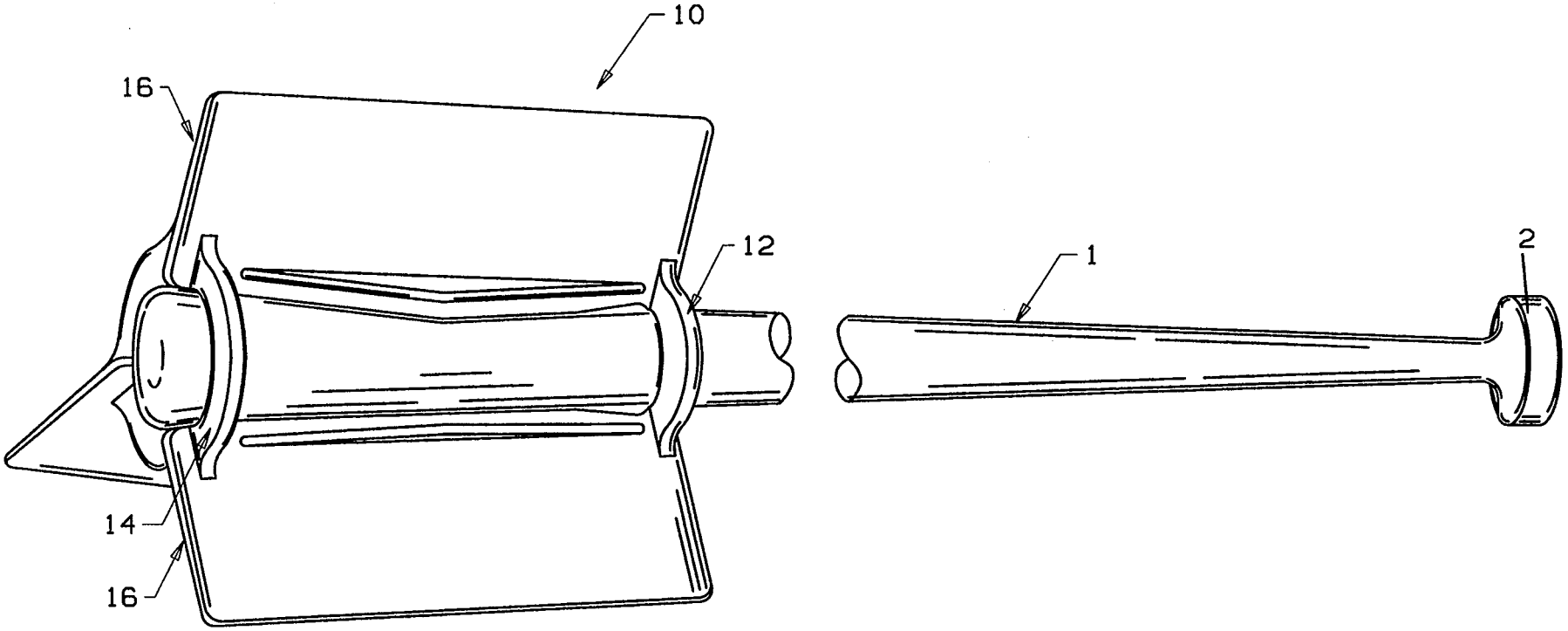
FIG. 1 is a perspective view of a training attachment unit made in accordance with the invention.
Figure 5:
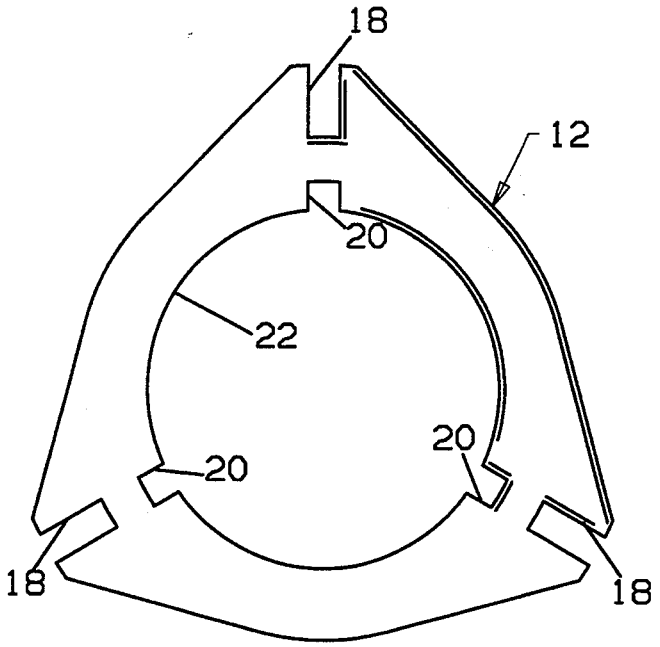
FIGS. 5–7 are side elevational views of collars used for mounting the FIG. 3 vane.
Figure 6:
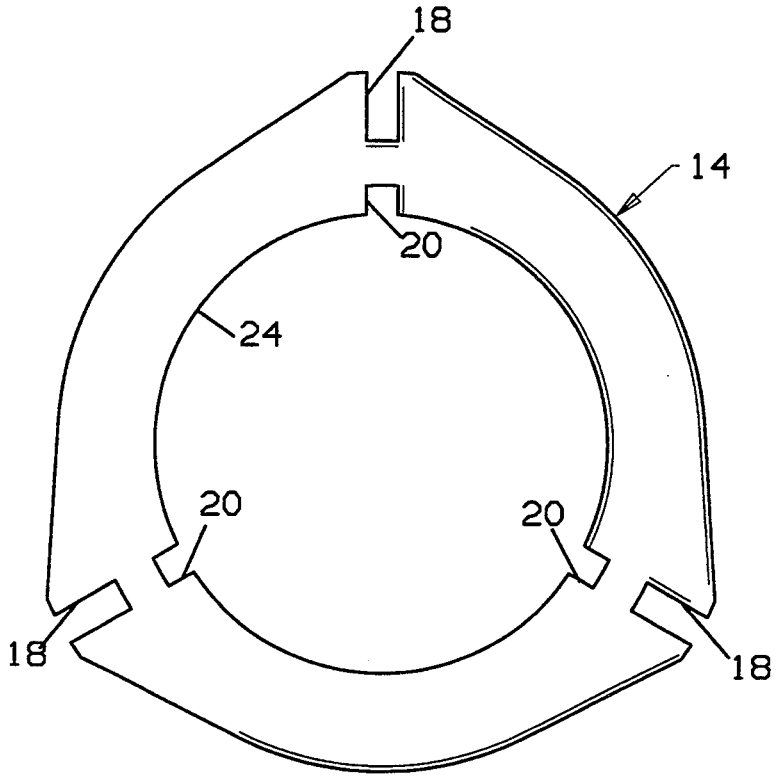
Figure 7:
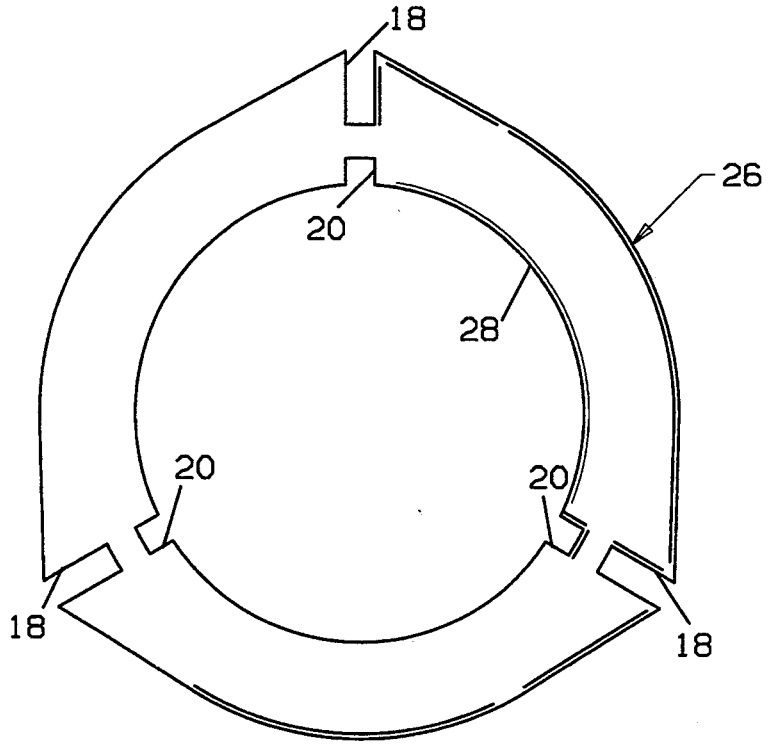

Turning now to FIG. 1 a training attachment device made in accordance with a first embodiment of the invention is identified by reference numeral 10. Attachment 10 comprises first and second collars 12,14 interconnected by a plurality of vanes 16 all of which may be formed of suitable moldable plastic material, such as recycled polyethylene. Collars 12 and 14 (see FIGS. 5 and 6) are each formed with longitudinally extending vane mounting slots 18 spaced around the outer periphery of the collars in alignement with additional slots 20 spaced around the inner periphery in communication with the bore of the respective collar. Collar 12 has a first bore 22 and collar 14 has a second bore 24, preferably larger than bore 24 when the training attachment is intended for use with a baseball bat. A third collar 26, to be discussed infra, also having longitudinally extending slots 18,20 spaced around its outer and inner peripheries respectively, has a bore 28 which is larger than bore 24.

Figure 3:
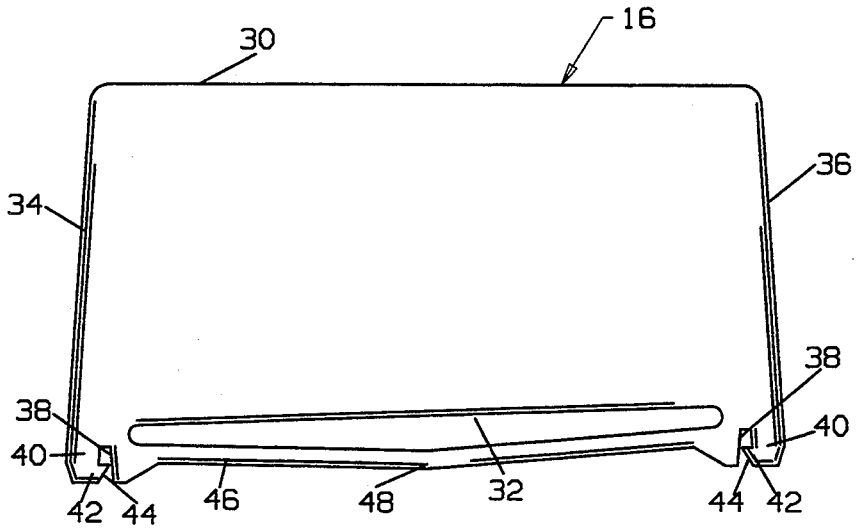
FIG. 3 is a front elevational view of a vane used in the FIGS. 1, 2 embodiment.
Figure 4:
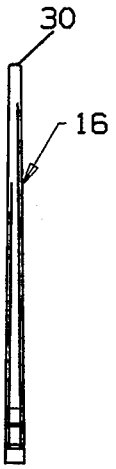
FIG. 4 is a side view of the FIG. 3 vane.

Vanes 16, best seen in FIGS. 3 and 4 have an upper or outer end 30, a lower or inner end 32 and sides 34,36 with attachment means formed at the lower end at each opposite side in the form of an upwardly extending slot 38 forming a tab portion 40 with a tooth 42 extending from the distal free end of tab 40 in a direction toward the opposite side of the vane. A vane 16 is attached to two respective collars, e.g., collars 12,14, by placing the vanes on the collars in a radial direction interfitting slots 38 and 18. Tooth 42 is formed with a beveled surface portion 44 which facilitates pushing of the tooth along the wall of the collar until it snaps into slot 20 locking the vane to the collar. As shown in the drawings, the collars are each formed with three grooves 18 for reception of three vanes. It will be understood that, if desired, a different number of vane positions can be provided within the scope of the invention.

Spring means in the form of an integral, generally V-shaped member 46 extends downwardly, or inwardly in relation to vane 16 mounted on the collars, from opposite side portions 34,36 to a central apex portion 48 spaced from lower end 32 and disposed below an imaginary line extending between the lower surface of tabs 40 for a purpose to be discussed below.

Preferably vanes 16 are formed with a taper on at least one face surface, as seen in FIG. 4, so that end 30 is thinner than end 32 thereby minimizing the weight of the attachment without sacrificing its strength.

For small bats such as those used by little leaguers, collars 12 and 14 having inner diameters of approximately 2 and $2\frac{1}{4}$ respectively, are used with collar 12 disposed at side 34 of vanes 16 and collar 14 at side 36. As seen in FIG. 3, tooth 42 on side 36 is spaced slightly closer to end 30 than is tooth 42 on side 34 because collar 14 has a slightly larger outer periphery than collar 12. This results in outer end 30 of vanes 16 extending in a direction which is generally parallel to the longitudinal axis of the bat.

Once the vanes are locked onto the collars the unit is ready for use with a bat, or other sporting goods implement used for striking an object. A bat, for example identified by numeral 1 in FIG. 1, is inserted, handle or small end 2 first, through bore 24 in collar 14 and then through bore 22 of collar 12 and moved longitudinally through the attachment until the outer surface of bat 1 is limited by engagement with the surface defining bore 22. Apex 48, already in engagement with the bat surface since it extends below a line joining the lower surfaces of tabs 40 which essentially coincide with the surfaces of bores 22,24, and the surface of bore 22 then firmly engage the bat. The bat can be handled without concern that the attachment will unintentionally slip toward the handle due to the frictional force of spring member 46. Attachment 10 can be removed from the bat by applying sufficient force to overcome the combined spring bias and wedging force of bore 22.

The attachment may be conveniently provided to the user in a small flat package containing the vanes and preferably three collars, 12,14 and 26 so that a unit can be easily assembled to fit any conventional bat. That is, collar 26 may be provided with a bore 28 of $2\frac{3}{4}$" so that it can be used along with collar 12 for full size bats.

Figure 8:
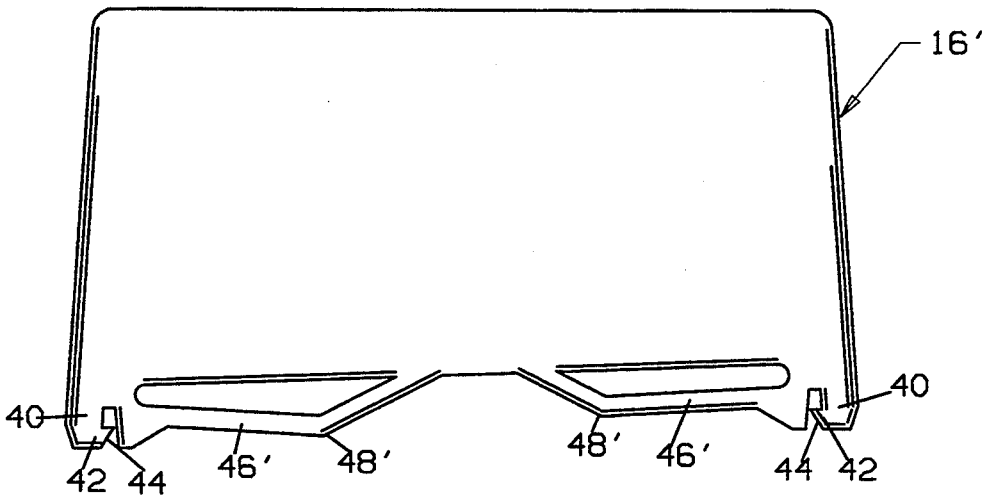
FIG. 8 is a view similar to FIG. 3 of a modified vane.

A modified vane is shown in FIG.8 in which the spring means formed on vane 16' comprises a pair of apexes 48' on first and second spring members 46'. This structure is particularly useful with implements which have little or no taper so that a stable, secure fit may be obtained even without wedging engagement of one of the collars with the surface of the implement, for example a hockey stick. The FIG. 8 vane can also be used with implements having a taper, if desired, and can be used with collars having the same or different diameter bores.

Figure 9:
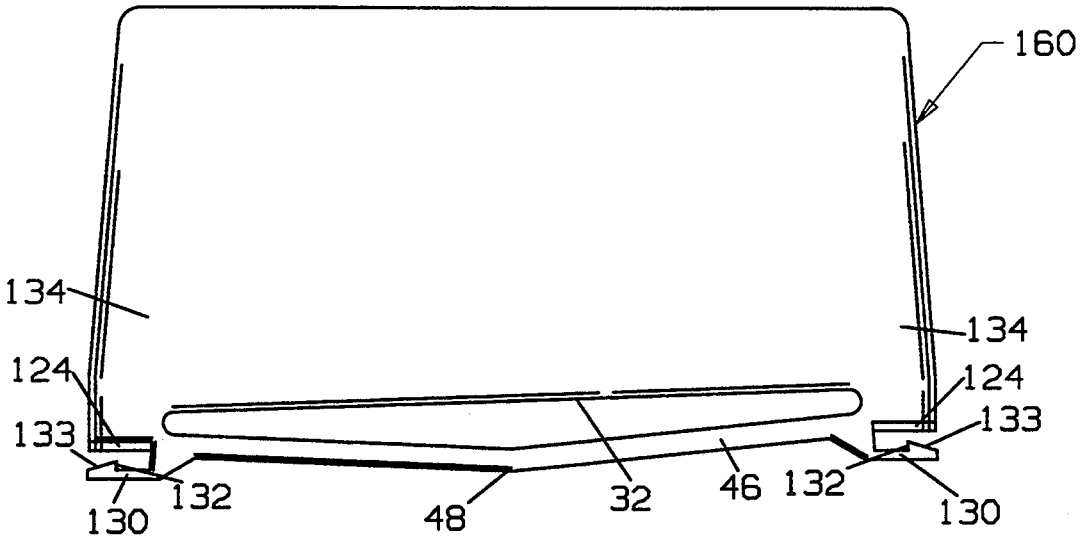
FIG. 9 is a view similar to FIG. 3 of a vane used in another embodiment of the invention.
Figure 10:
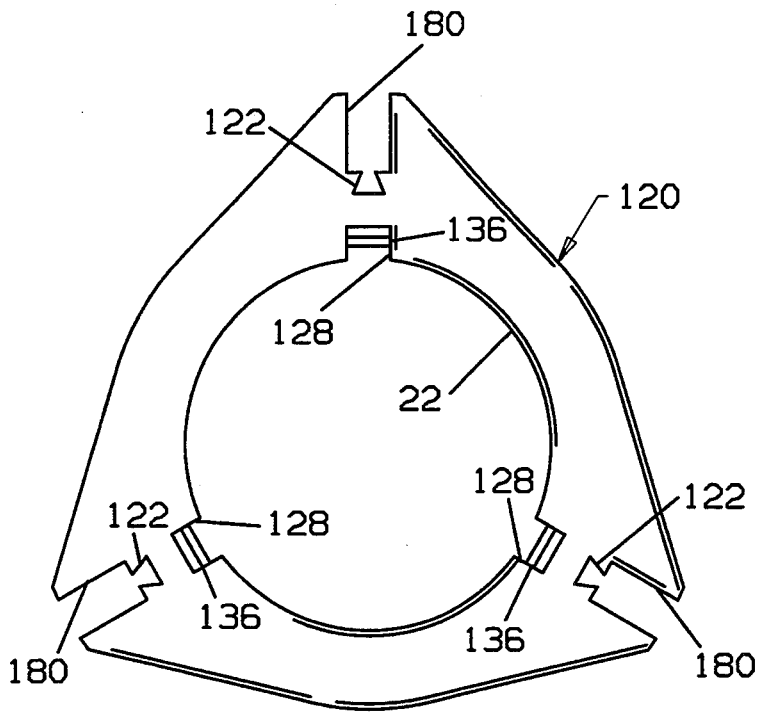
FIG. 10 is a side view similar to FIGS. 5–7 of a collar used for mounting the FIG. 9 vane.
Figure 11:
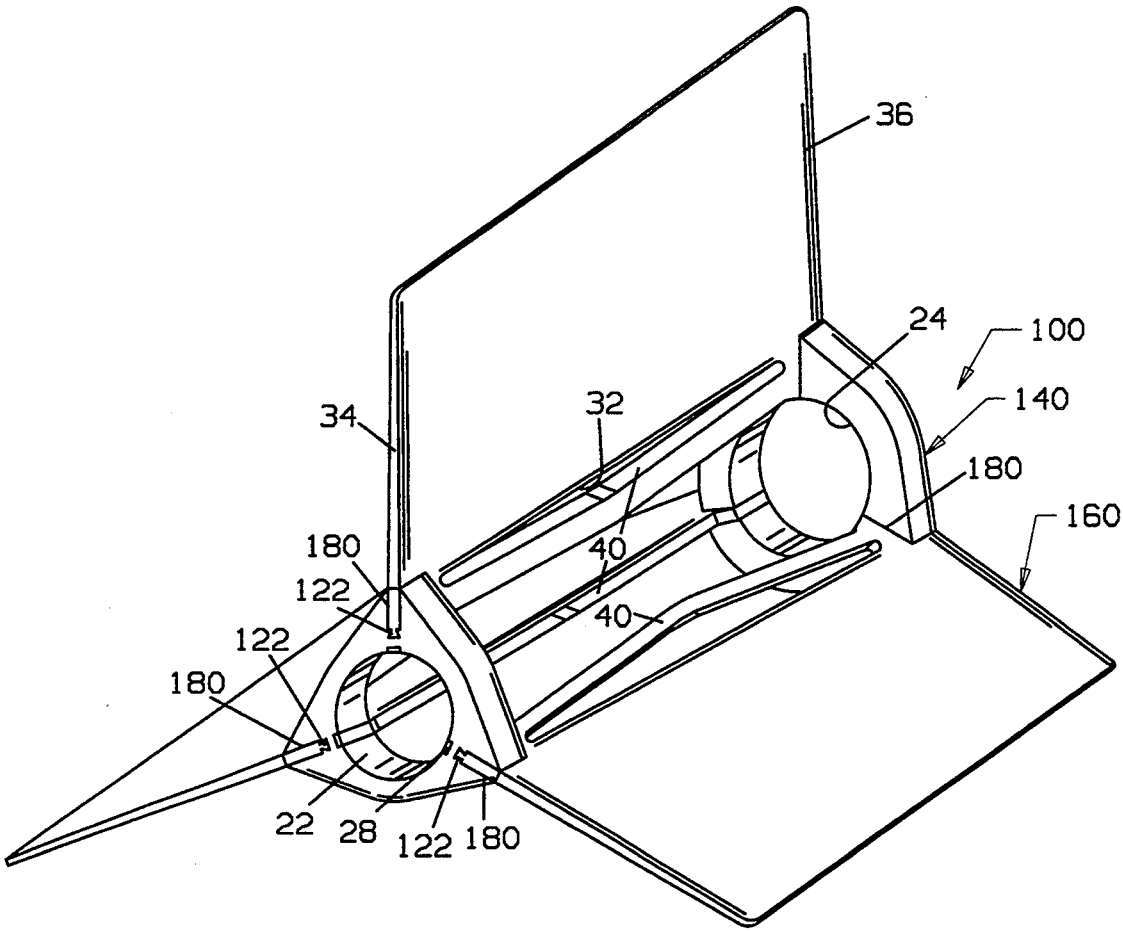
FIG. 11 is a perspective view of a training aid unit made in accordance with the FIGS. 9,10 embodiment of the invention.
Figure 12:
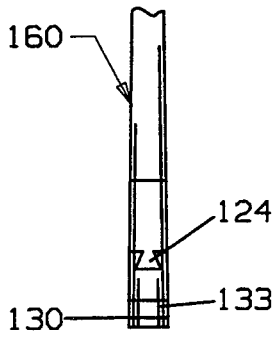
FIG. 12 is a broken away side view of the FIG. 9 vane.

FIGS. 9–11 show another embodiment of the invention in which the attachment means requires assembly of the vanes in a longitudinal direction. As seen in FIG. 10, collar 120 is provided with a plurality of longitudinally extending slots 180 formed about the outer periphery of the collar, each having a dovetail type of groove configuration 122 which alows a correspondingly shaped projection portion 124 to slide into groove 122 in a longitudinal direction, i.e., in a direction generally parallel to the longitudinal axis of bores 22,24 respectively of collars 120,140, at the same time preventing movement of vanes 16 in an outwardly radial direction. It will be appreciated that any configuration having a reduced thickness portion between contiguous relatively thicker portions of the base will serve to prevent outward radial motion of the vane from a correspondingly configured slot in the collar. Preferably a slot 128 is also formed in collars 120,140 in communication with bores 22,24 respectively and aligned with each groove 180 for a purpose to be described below.

Vanes 160, as best seen in FIG. 9, include a tab 130 having an upwardly projecting tooth 132 with an inclined ramp 133 spaced from mounting portion 134 on which dovetail projection 124 is formed. Slot 128 is formed with a recess 136 adapted to lockingly receive tooth 132. That is, as mounting portion 134 is inserted into groove 180 ramp 133 engages the inner surface of slot 128 forcing the outer distal end of tab 130 to move downwardly, as seen in FIG. 9, until tooth 132 slips into recess 136. When so mounted both longitudinal and radial motion of the vane relative to the collar is prevented.

Figure 2:
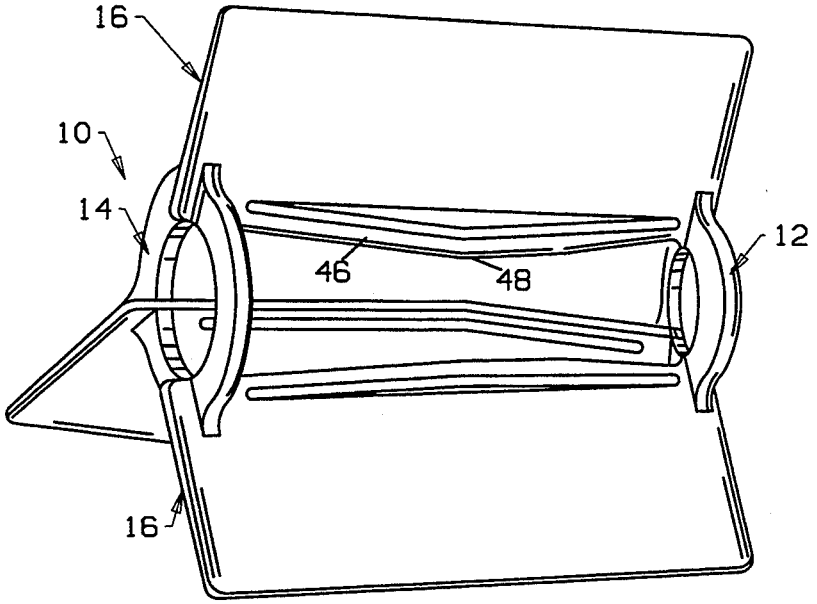
FIG. 2 is similar to FIG. 1 but shown without the bat.

Vanes 160 are integrally formed with a spring portion 46, as in the FIG. 2 embodiment, which extends downwardly, as seen in FIG. 9, from base portion 32 in a generally V-shape with the spacing of spring portion 40 from the base portion 42 increasing in a direction going toward the central or apex portion 48 thereof from opposite sides of the vane.

Preferably, vanes 160 have a thickness which decreases in a direction going from the mounting portion 34 to the outer free distal end 30 to minimize the weight of the attachment as stated above with reference to the first embodiment of the invention.

Figure 13:
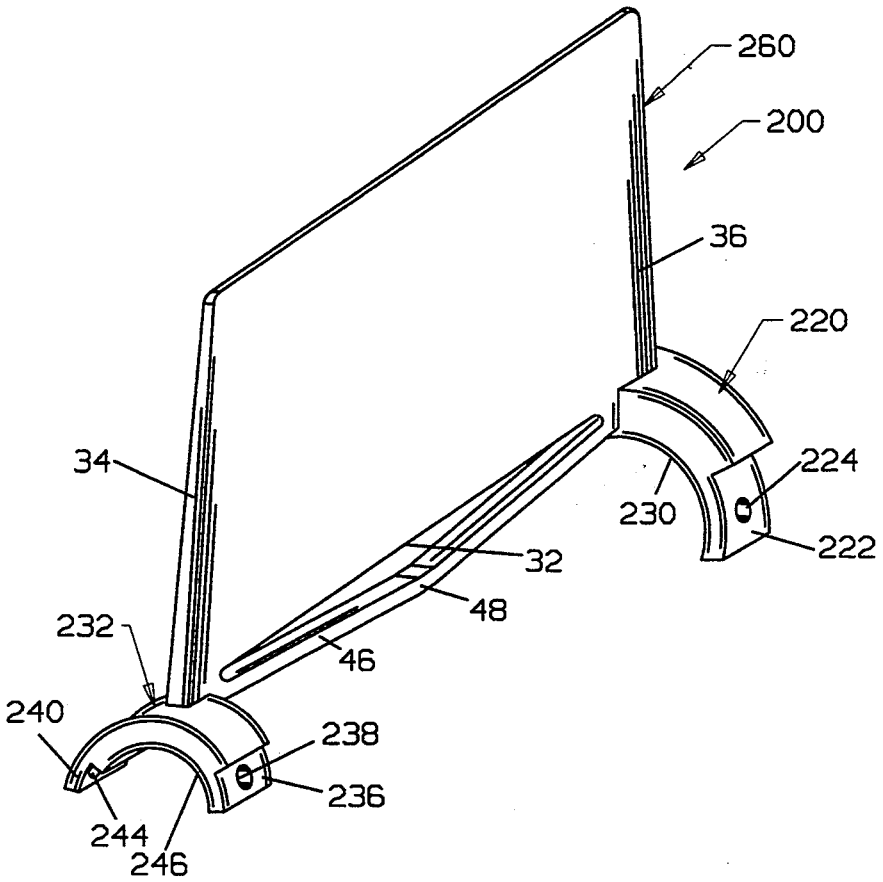
FIG. 13 is a perspective view of one section of a plurality of sections forming a training attachment unit made in accordance with another embodiment of the invention.
Figure 14:
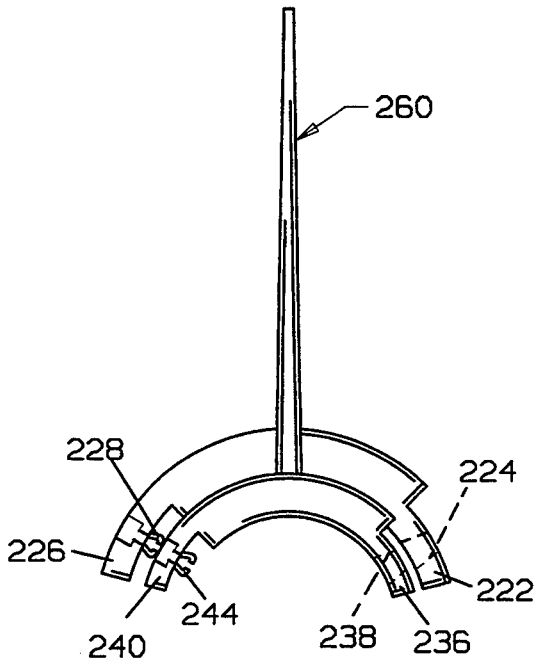
FIG. 14 is a side view of the FIG. 13 section.

With reference to FIGS. 13 and 14, an embodiment of the invention is shown in which a training attachment comprises a plurality of interlocking sections 200 adapted to be received on the implement. Each section 200 comprises a vane 260 having a first inner end portion 32, or lower portion as seen in FIG. 13, formed with an integrally attached spring section 46. Vane 260 is attached at side portion 36 at its inner end 32 to a first collar segment 220 extending a selected angular portion of an annulus. In the embodiment shown three collar segments 220 form a single attachment unit so that first collar segment extends for 120 degrees. Collar segment 220 has an inner tab 222 at one end formed with an aperture 224 therethrough and an upper tab 226 (FIG. 14) at its opposite end formed with a knob 228 extending inwardly away from the tab. Knob 228 is formed with a plurality of fingers which spread outwardly in their at rest condition in a direction extending away from the tab but being capable of being compressed together.

Aperture 224 is frustoconical in shape with its smaller diameter at the outer surface of tab 222. Collar segment 220 is formed having an inner surface 230 having a selected radius.

A second collar segment 232 extending the same angular portion of an annulus as collar segment 220, i.e., 120 degrees, is attached to vane 260 at side 34 at its inner end 32. Collar segment 232 has a lower tab 236 formed with an aperture 238 preferably shaped in the same configuration as aperture 224 of tab 222. An outer tab 240 is formed at the other end of collar segment 232 and has knob 244, shaped in the same configuration as knob 238 extending inwardly from the tab. Collar segment 232 has an inner surface 246 having a second selected radius. In the embodiment shown, the second selected radius is chosen to be less than the radius of surface 230 to allow for the taper of a baseball bat.

As mentioned above, three sections 200 are used for a single attachment unit and are coupled together by placing upper tabs 226,240 of one section onto respective lower tabs 222,236 of another section and by forcing knobs 228,244 of the one section through respective apertures 224,238 of the other section.

When used for a training atachment for a baseball bat the knob end of the bat is inserted through the bore formed by the coupled first collar segments 220 and moved therethrough until spring apex sections 48 are biased into by engagement with the bat surface to create a force fit on the bat.

It will be seen that the invention provides a training aid which is useful with a wide variety of implements and which is inexpensive yet rugged and safe for use even by children. The first two embodiments also have the advantage of being particularly conducive to packageing for sale in a compact, flat package which is easily handled, shipped and stored.

It should be understood that though preferred embodiments of the invention have been described by way of illustrating the invention, this invention includes all modifications and equivalents of the disclosed embodiments falling within the scope of the appended claims.

What is claimed is:

1. A hitting training attachment suitable for use with an elongated hitting implement used for striking objects comprising first and second collars, each collar having a bore with a longitudinal axis, a plurality of substantially planar vanes having elongated first and second opposed edges and first and second side portions, attachment means for lockably attaching the first and second side portions adjacent the first edge to a respective collar; said vanes being spaced around the periphery of the respective collar such that said longitudinal axes of said first and second collars are colinear and so that each vane lies in a plane in which the longitudinal axis lies; and each said vane having an integral resilient portion along at least a portion of said first edge and being configured such that when said training attachment is placed on a hitting implement said resilient portion will frictionally hold said attachment on said hitting implement.

2. A training attachment according to claim 1 in which the attachment means include a plurality of longitudinally extending slots formed in the first and second collars spaced around the outer periphery of each collar, the vanes radially received in respective slots.

3. A training attachment according to claim 2 in which an additional longitudinally extending slot is formed in each collar in communication with the bore of the respective collar and in alignment with a respective slot in the outer periphery and the vane is formed with a tab receivable in the additional slot.

4. A training attachment according to claim 1 in which the attachment means include a plurality of longitudinally extending slots formed in the first and second collars spaced around the outer periphery of each collar, the vanes received in respective slots in a direction parallel to the longitudinal axis.

5. A training attachment according to claim 4 in which an additional longitudinally extending slot is formed in each collar in communication with the bore of the respective collar and in alignment with a respective slot in the outer periphery and the vane is formed with a tab receivable in the additional slot.

6. A training attachment according to claim 1 in which there are three vanes lockably attachable to the collars.

7. A training attachment according to claim 1 which the said resilient portion is formed with a central apex portion, the distance between the apex portion and the longitudinal axis being less than the distance between the attachment means and the longitudinal axis when the respective vane is attached to the collars.

8. A training attachment according to claim 1 in which the vanes and the collars are formed of a moldable synthetic resin.

9. A training attachment according to claim 1 in which the vanes and the collars are formed of recycled polyethylene.

10. A training attachment according to claim 1 in which the first and second collars each have an inner surface having a diameter, the diameter of the inner surface of the first collar being greater than the diameter of the second collar.

* * * * *